United States Patent [19]

Yoshizawa

[11] 4,012,898

[45] Mar. 22, 1977

[54] ROTARY INDICATING PLATE TYPE DIGITAL DISPLAY DEVICE

[75] Inventor: Keiichi Yoshizawa, Tokyo, Japan

[73] Assignee: Kabushiki Kaisha Seikosha, Japan

[22] Filed: Feb. 4, 1975

[21] Appl. No.: 546,898

[30] Foreign Application Priority Data

Feb. 4, 1974 Japan ..... 49-14273

[52] U.S. Cl. ..... 58/2; 58/126 E

[51] Int. Cl.[2] ..... G04B 45/00; G04B 19/00

[58] Field of Search ..... 58/2, 4, 6, 125 C, 126 E, 58/127

[56] References Cited

UNITED STATES PATENTS

| | | | |
|---|---|---|---|
| 1,090,172 | 3/1914 | Shanks | 58/126 E |
| 3,220,174 | 11/1965 | Cappellari | 58/2 R |
| 3,830,053 | 8/1974 | Koide et al. | 58/2 X |

*Primary Examiner*—George H. Miller, Jr

*Attorney, Agent, or Firm*—Robert E. Burns; Emmanuel J. Lobato; Bruce L. Adams

[57] ABSTRACT

A rotary time-indicating plate-type digital display device comprises a rotary minute drum carrying a set of minute-indicating plates and a rotary hour drum carrying a set of hour-indicating plates. A drive system effects continuous rotation of the minute drum to individually turn over successive minute-indicating plates to display the time in minutes and effects intermittent rotation of the hour drum to individually turn over successive hour-indicating plates to display the time in hours. A lower system coacts with the minute and hour drums to effect synchronous turning over of the minute-indicating plate which indicates the 59th minute and each successive hour-indicating plate. An adjusting mechanism is disposed adjacent the minute drum for enabling adjustment of both the minute and hour drums to set the time displayed by the indicating plates.

4 Claims, 12 Drawing Figures

II
II
III
III
1
2
3
4
5
6
7
8
9
10
12
13
14
15
16
17
18
21
22
23
24
25
26
27
28
29
29a
32
33
34
35
36
37
38
39
40
41
42
46
47
48
49
51
52
58
63
64

1
1a
1b
1c
1d
1e
A
A1
A2
A3
B1
B2
B3
B'60
A'60

ROTARY INDICATING PLATE TYPE DIGITAL DISPLAY DEVICE

BACKGROUND OF THE INVENTION

This invention relates to a rotary indicating plate type digital display device.

In rotary indicating plate type digital display devices of a clock, etc., the driving system for a minute drum and an hour drum has heretofore included two types. One of them continuously drives both the minute drum and the hour drum, while the other intermittently drives both the minute drum and the hour drum. With the former type, a shear arises in the indicated characters of the hour and the minute, and hence, the number of hour indicating plates need be made large. Besides, the independent corrections of the hour and the minute are difficult. Further, in order that the change of the minute indication from "59" to "00" and the change of the hour indication may be carried out at the same time, specific minute indicating plates, for example, minute indicating plates for indicating "45" – "59" are provided with projecting pieces, and an engaging spring which shifts to the front of the hour indicating plate in interlocking relationship with the projecting piece is provided between the hour drum and the minute drum. In consequence, the spacing between the hour drum and the minute drum becomes large. Moreover, when a calender mechanism is provided, the date or the day of the week does not change exactly at 12.00 p.m., but errors of several minutes are involved. On the other hand, the latter type requires a driving torque which is greater than in the former. In addition, a comparatively large noise is generated every minute by the intermittent drive and such noise is offensive to the ear.

SUMMARY OF THE INVENTION

According to this invention, there is provided a rotary indicating plate type digital display device comprising a rotary indicating mechanism for the minute indication and which is continuously driven, a cam which interlocks with the minute drive mechanism, and a rotary indicating mechanism for the hour indication which is intermittently driven by the cam.

An object of this invention is to effect the change of the hour indication at the same time that the minute indication changes from "59" to "00."

Another object of this invention is to realize a drive system which requires only a comparatively small driving torque.

Still another object of this invention is to diminish the shear in indicated characters by intermittently driving a drum for the hour indication.

Yet another object of this invention is to make it possible to independently correct the minute indication and the hour indication.

BRIEF DESCRIPTION OF THE DRAWING

The above and other objects and features of this invention will become apparent from the following description and the statement of the appended claims when considered with reference to the accompanying drawing in which:

DESCRIPTION OF THE PREFERRED EMBODIMENT

Figure 1:
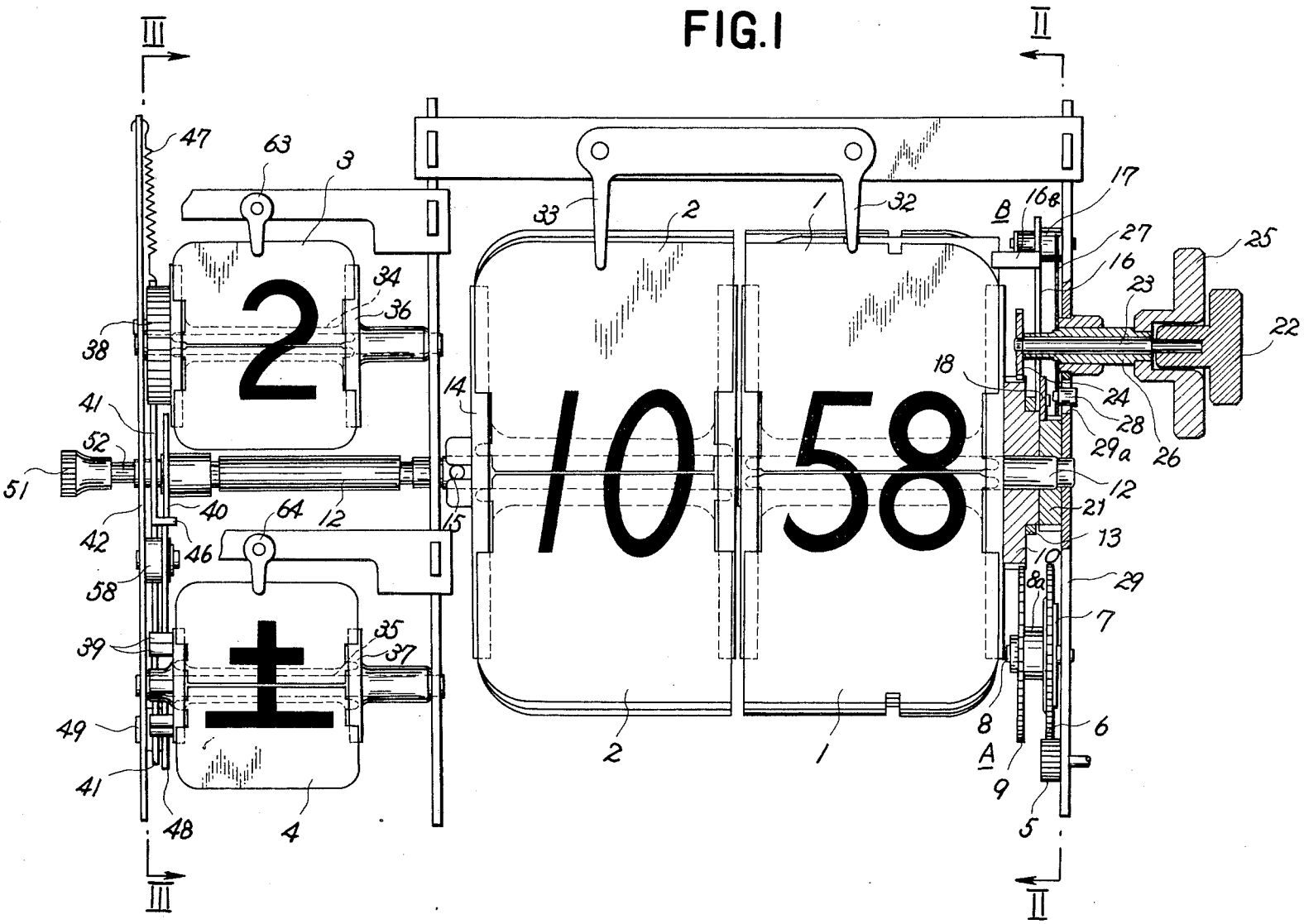
FIG. 1 is a front view, partially in section, showing an embodiment of this invention.

Referring to FIG. 1, a time indicating portion of the device has sixty minute-indicating plates 1, . . . , and twenty-four hour-indicating plates 2, . . . . which lie on the left of the minute indicating plates. On the left of the time indicating portion, thirty-one date-indicating plates 3, . . . . are disposed above, while seven day-of-the-week indicating plates 4, . . . . are disposed below.

First, a driving mechanism A for the minute-indicating plates 1, . . . will be explained. The rotation of a motor (not shown) is transmitted to a pinion 5.

Figure 2:
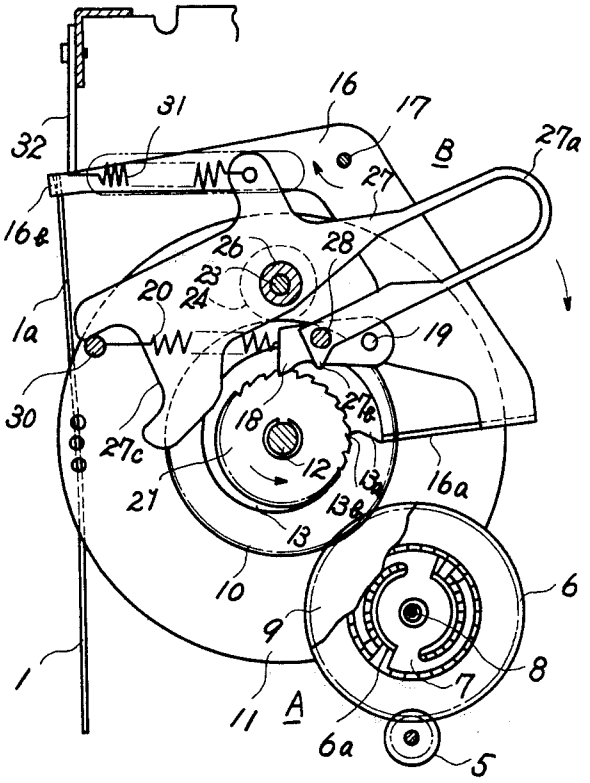
FIG. 2 is a sectional view taken along line II—II in FIG. 1.

The pinion 5 meshes with a gear 6. A tooth 6*a* is formed on the right side surface of the gear 6 as shown in FIG. 2, and it meshes with a pawl 7. A seat 8*a* is rotatably supported on an arbor 8, as seen in FIG. 1, and at one end of the seat 8*a*, the gear 6 is rotatably supported, and the pawl 7 is secured whereas at the other end of the seat 8*a* is mounted an intermediate gear 9 which meshes with a minute driving gear 10. The minute driving gear 10 is formed integrally with a minute drum 11. The minute drum 11 is rotatably supported on a main shaft 12, and has the sixty minute-indicating plates 1 rockably or pivotably mounted thereon at equal intervals along its outer periphery. The minute-indication is made by two minute indicating plates. Each time one elapses, the upper indicating plate turns over and falls, and the next minute increment of time is indicated. A cam 13 is secured to the minute driving gear 10. The cam 13 is formed with a crest 13*a* and a trough 13*b*.

Description will now be made of a driving mechanism B for the hour-indicating plates 2, . . . An hour drum 14 rotates together with the main shaft 12 through a pin 15 which is planted on the main shaft 12. Along the outer periphery of the hour drum 14, the twenty-four hour-indicating plates 2 are rockably or pivotably mounted at equal intervals. Referring to FIGS. 1 and 2, an hour driving lever 16 is rockably supported on an arbor 17. It is formed at one end with a sliding party 16*a* which the cam 13 follows, and at the other end with a hook part 16*b* which catches the minute-indicating plate 1. An hour driving pawl 18 for the hour driving lever 16 is rockably mounted by a pin 19. A coiled spring 20 is retained so as to bestow a turning or biasing force which tends to turn the hour driving lever 16 clockwise in FIG. 2 about the arbor 17. By the turning of the hour driving lever 16 in the clockwise direction in FIG. 2, a ratchet wheel 21 secured to the main shaft 12 has one detent fed by the hour driving pawl 18.

A corresponding mechanism will now be described. A minute correcting gear 24 is secured at the fore end of an arbor 23 of a minute correcting knob 22, and it meshes with the minute driving gear 10. An hour correcting knob 25 is secured to a pipe or tubular member 26 which is free to rotate relative to the arbor 23, and to which an hour correcting lever 27 is secured. The hour correcting lever 27 has a U-shaped elastic part 27*a*, which is formed at its fore end with a driving pawl 27*b* engageable with the ratchet wheel 21. By securing a pin 28 to the pawl part and snugly fitting the pin into a guide hole 29*a* provided in a supporting plate 29, the ratchet wheel 21 is so controlled as to prevent two or more detents from being fed. At the end of the hour correcting lever 27 remote from the elastic part 27*a*, there is formed a guide groove 27*c*, whose rocking angle is controlled by a pin protruding from the supporting plate 29. The lever 27 is given a counterclockwise turning force by a coiled spring 31, so that the driving pawl 27*b* is held at a position spaced from the ratchet wheel 21. Retaining pieces 32 and 33 keep the minute-indicating plate 1 and the hour-indicating plate 2 at rest till the time of their turning-over and falling, respectively. The hook part 16*b* is formed so that it can engage with only the minute-indicating plate 1*a* indicative of "59" minutes among the minute-indicating plates 1.

A calendar mechanism will now be explained. The date-indicating plates 3 and the day-of-the-week indicating plates 4 are rockably mounted at equal intervals on a date drum 36 and a day-of-the-week drum 37 secured to arbors 34 and 35, respectively. Driving mechanisms for the respective indicating plates 3 and 4 will be described with reference to FIG. 3. A date driving ratchet wheel 38 is secured at an end of the date drum 36. Day-of-the-week driving pins 39, . . . protrude from one end of the day-of-the-week drum 37.

At the fore end of the main shaft 12, a cam 40 is secured. The cam 40 has a crest 40*a* and a trough 40*b*. An upper part of a driving lever 41 is formed with a guide groove 42*a* which engages with a guide pin 43 planted on a side plate 42, a central part is formed with a through hole 42*b* through which the main shaft 12 penetrates, and a lower part has a pin 44 planted thereon which engages with a guide groove 42*c* provided in the side plate 42. Accordingly, the driving lever 41 is slidable in the vertical direction and the sliding amount thereof is controlled within a predetermined range. The driving lever 41 is formed with a date driving pawl 45 and a sliding piece 46 which slides on the cam face of the cam 40. The driving lever 41 is drawn upwards in FIG. 3 by a coiled spring 47. A day-of-the-week driving lever 48 is rockably supported by a pin 49, and a guide groove 50 formed in the lever 48 is coupled by the pin 44. The fore end part of the day-of-the-week driving lever 48 is engageable with the driving pins 39.

Figure 3:
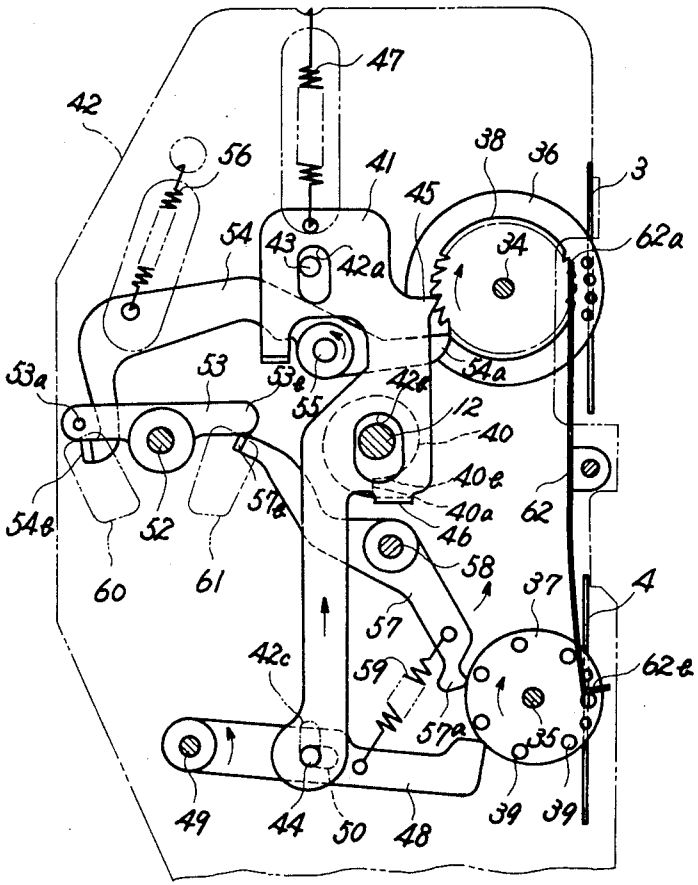
FIG. 3 is a sectional view taken along line III—III in FIG. 1.

A correcting device for the calendar mechanism will be described with reference to FIG. 3. A correcting lever 53 having two arms 53*a* and 53*b* is secured to an arbor 52 of a correcting knob 51 (in FIG. 1). A date correcting lever 54 is rockably supported on an arbor 55. At one end of the lever 54 is a pawl 54*a* engageable with the ratchet wheel 38. At the other end is an engaging piece 54*b* engaging with the arm 53*a* of the correcting lever 53 and a coiled spring 56. A day-of-the-week correcting lever 57 is rockably supported on an arbor 58. At one end of the lever 57 is a pawl 57*a* engageable with the pins 39 while at the other end is an engaging piece 57*b* engaging with the arm 53*b*. A coiled spring 59 is retained between the levers 57 and 48. In order to prevent both the correcting lever 54 and 57 from feeding two or more detents, their rocking angles are controlled in such way that the extreme ends of the engaging pieces 54*b* and 57*b* are respectively engaged with stopper windows 60 and 61 provided in the side plate 42. A click spring 62 has its upper end part 62*a* resiliently engaged with the ratchet wheel 38, and has its lower end part 62*b* resiliently engaged with the pins 39 on the left side surface of the day-of-the-week drum 37. Retaining pieces 63 and 64 (in FIG. 1) keep the date-indicating plate 3 and the day-of-the-week indicating plate 4 at rest till their turning-over and falling, respectively.

Figures 4, 5, 6, 7, 8, 9, 10, 11, 12:
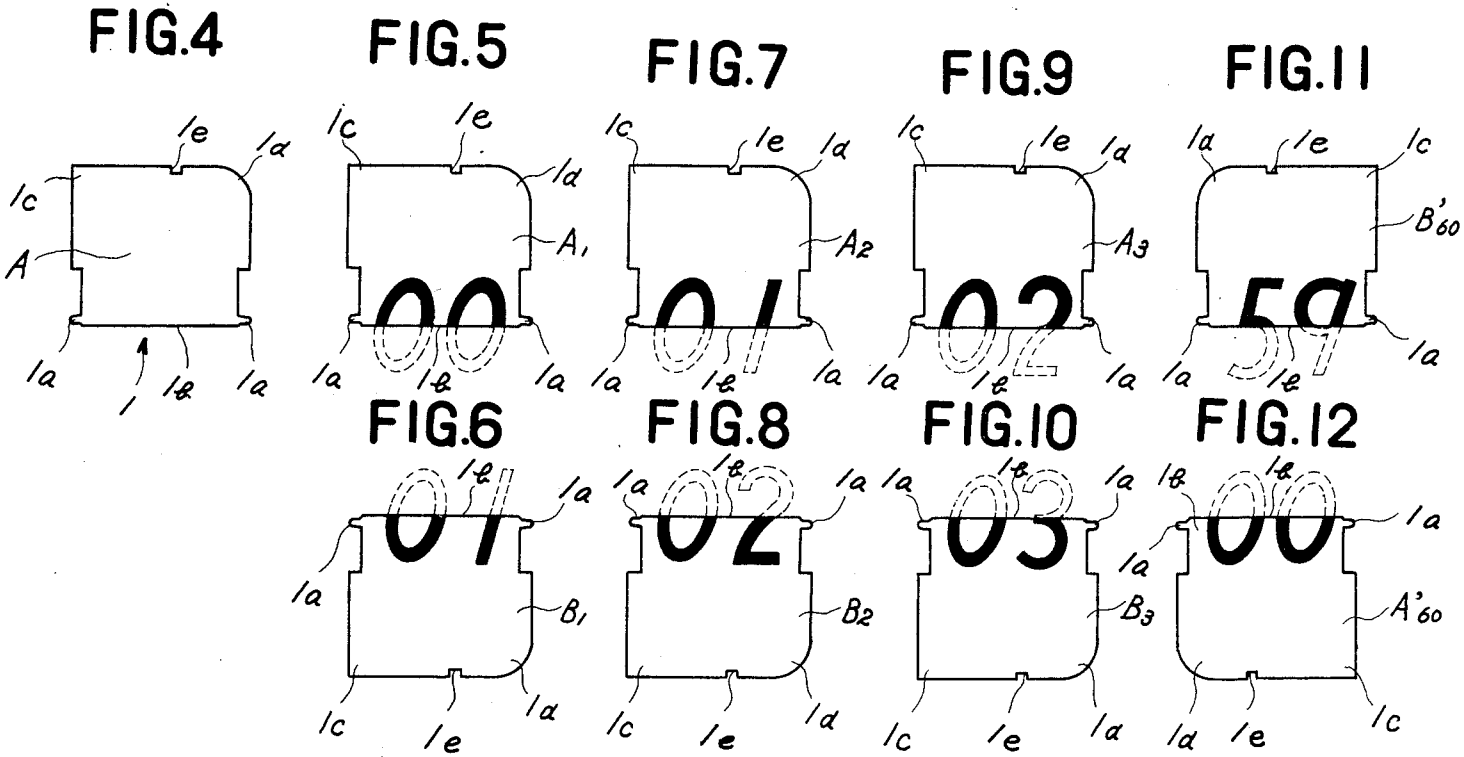
FIG. 4 is a front view of an indicating plate.
FIGS. 5 to 12 are front views of various minute-indicating plates with indicating characters printed thereon.

Referring now to FIG. 4, description will be made of the shape of the minute-indicating plate 1 and the printing of minute indicating characters.

The minute-indicating plates 1, . . . have projections 1*a* and 1*a* on both the sides. The center line or substantially the lower edge 1*b* becomes the center of rocking. The left corner of the upper edge is formed into a square 1*c*, while the right corner is cut into an arc 1*d*. A notch 1*e* is provided at the upper edge of the indicating plate 1. The notch 1*e* corresponds to the retaining piece 32 when "59" is indicated in case of printing the minute indicating characters as will be stated below. Sixty of the minute-indicating plates 1, . . . of such identical shape are prepared.

The printing of the time indicia or indicating characters will now be described. The front surface of the minute-indicating plate 1 at the time when the rocking center edge 1*b* lies at the base of the plate and the arc l*d* lies at the upper right corner, as shown in FIG. 4, is termed the surface A, while the rear surface is termed the surface B. The upper half of "00" is printed on the surface $A_1$ of the first minute-indicating plate as illustrated in FIG. 5, while the lower half of "01" is printed on the surface $B_1$, which appears by turning over the first plate with respect to the lower edge 1*b*, as illustrated in FIG. 6. The upper half of "01" is printed on the surface $A_2$ of the second minute-indicating plate as illustrated in FIG. 7, and the lower half of "02" on the surface $B_2$ as illustrated in FIG. 8. Likewise, the upper half of "02" is printed on the surface $A_3$ of the third minute-indicating plate as illustrated in FIG. 9, and the lower half of "03" on the surface $B_3$ as illustrated in FIG. 10. In the same way, predetermined indicating characters are printed on the surfaces A and B of the fourth to fifty-ninth minute-indicating plates. The last sixtieth minute-indicating plate is as shown in FIGS. 11 and 12, and is bilaterally inverse with respect to the other minute-indicating plates. The upper half of "59" is printed on the front surface at the time when substantially the lower edge 1*b* is the center of rocking and the upper right corner is the square 1*c*, that is, the rear surface $B'_{60}$, while the lower half of "00" is printed on the surface $A'_{60}$ which appears by turning over the sixtieth plate with respect to the lower edge 1*b*. When the minute-indicating plates printed as described above are mounted on the minute drum 11, the square corner 1*c* of the last minute-indicating plate protrudes beyond the remaining minute-indicating plates as illustrated in FIG. 1. The retaining part 16*b* is engageable with only the protruding part (the square corner 1*c* of the last minute-indicating plate).

Although the minute-indicating plates 1 has been described above as being formed by printing the indicating characters after press punching, it can be quite similarly formed by performing the press punching after the printing.

The mode of operation of the device will now be explained. Upon the rotation of the motor, the motor pinion 5 is rotated. In interlocking relationship therewith, the gear 6, pawl 7, seat 8*a*, intermediate gear 9 and minute driving gear 10 are rotated. In consequence, the minute drum 11 is rotated, the upper stage one of the minute-indicating plates 1 comes away from the retaining piece 32 and turns over and falls, and the next minute indication is established. Since the indicating plates of from "00" to "58" are located so that the upper right corner of the indicating plate at the upper stage is the arc 1*d* as illustrated in FIG. 4, the hook 16*b* of the hour driving pawl 16 does not fasten the upper right corner of the minute-indicating plate. Accordingly, the upper stage of indicating plate 1 turns over and falls for the next indication when the minute drum 11 is fed to a position at which the plate gets clear of the retaining piece 32. In this manner, the minute-indicating plates 1 are driven in succession to display the minute increment of time. At the indication of "59," the minute-indicating plate 1 is located so that the right upper corner is the square 1*c*, and the notch 1*e* lies so as to just oppose the retaining piece 32. Therefore, when the minute drum 11 is fed, the notch 1*e* passes through the retaining piece 32 and is freed therefrom before the time at which the upper stage of minute-indicating plate 1 is to fall. The upper stage of indicating plate, however, does not turn over and fall because the hook 16*b* of the hour driving lever 16 engages the corner 1*c* of the indicating plate. Upon elapse of one further minute, the sliding part 16*a* of the hour driving lever 16 drops from the crest 13*a* to the trough 13*b* of the cam 13.

Due to such a construction, the hour driving lever 16 rocks clockwise, and the hook 16*b* moves upwards to release the minute-indicating plate 1. Then, the minute-indicating plate 1 turns over and falls, and the next minute "00" is indicated.

Even if the retaining piece 32 engaging with the upper stage of indicating plate 1 releases the engagement before the hook 16*b* is disengaged from this indicating plate, such is rather desirable for the precision of the lower digit indication. Simultaneously with the indication change of the minute-indicating plates from "59" to "00," the ratchet wheel 21 is fed by one detent by means of the driving pawl 18, the main shaft 12 is rotated to disengage the hour-indicating plate 2 from the retaining piece 33 through the hour drum 14, and the hour-indicating plate 2 turns over and falls, so that the next hour indication is made thereby displaying the hour increment of time.

Since, in this manner, the hour drum 14 is intermittently driven by the hour driving lever 16 coacting with the cam 13, the center line of the hour-indicating plates 2 is normally kept stationary at the center line of the display plane. The minute-indicating plates 1 are subjected to continuous drive as the minute drum 11 is interlocked with the rotation of the drive motor. Therefore, when the sixty minute-indicating plates 1 are included as in this embodiment, a movement over 6° in terms of the central angle is continuously performed downwards from above the center line of the display plane. That is, in this embodiment, the shear between the indicated characters of the hour and the minute is at most 3° in terms of the central angle, and this value is not exceeded. Owing to the intermittent drive of the hour drum 14, any mechanism for checking the hour-indicating plates from turning over and falling till the correct time, such as is required in the case of the continuous drive, is unnecessary. Accordingly, the minute drum 11 and the hour drum 14 may be disposed in a manner to lie almost in contact, and the spacing between both the drums is diminished.

When the main shaft 12 is rotated by just one revolution by the sequential turnings owing to the above operation, the cam 40 also undergoes one revolution. With the rotation of the cam 40, the lever 41 is gradually pushed down by the sliding piece 46. FIG. 3 shows the state of the sliding piece 46 immediately before dropping from the crest 40*a* to the trough 40*b*. When the sliding piece 46 drops to the trough 40*b* at the next moment, the lever 41 is instantly slid upwards by the coiled spring 47. At this time, the date driving pawl 45 feeds the ratchet wheel 38 by one detent. Simultaneously therewith, the day-of-the-week driving lever 48 is rocked through the pin 50, to feed one pin 39. Owing to the rotation of the ratchet wheel 38 by one detent, one date-indicating plate 3 is caused to turn over and fall through the date drum 36, and the next date is indicated. Owing to the feed of the pin 39, one day-of-the-week indicating plate 4 is caused to turn over and fall through the day-of-the-week drum 37, and the next day-of-the-week is indicated.

Manual corrections of the indications will now be described. When the minute correcting knob 22 is turned, the arbor 23, minute correcting gear 24 and minute driving gear 10 are rotated, and the minute-indicating plate 1 is fed in the same way as described above. The rotation of the minute driving gear 10 at this time results in that the pawl 7 merely slides on the tooth 6*a* of the gear 6 through the intermediate gear 9 as well as the seat 8*a*, and it bestows no rotation. Consequently, the gear 6 is not rotated, and any unreasonable influence is not exerted on the motor, etc. When the hour correcting knob 25 is turned, the hour correcting lever 27 is rocked through the pipe 26. The driving pawl 27*b* therefore feeds the ratchet wheel 21 by one detent, and the hour-indicating plate 2 is thus driven in the same way as described above. When the hour correcting lever 27 is to return to the original position by the coiled spring 31, the elastic part 27*a* bends and causes the driving pawl 27*b* to escape from the detent of the ratchet wheel 21, and hence, the ratchet wheel 21 is not damaged.

In case of correcting the date, the correcting knob 51 is turned counterclockwise. Then, the arbor 52 and the lever 53 rotate counterclockwise in FIG. 3, and the engaging piece 54*b* of the date correcting lever 54 is pushed down. The pawl 54*a* therefore moves upwards. At this time, the ratchet wheel 38 is fed by one detent, and the date-indicating plate 3 is driven. In case of correcting the day-of-the-week, the correcting knob 51 is turned clockwise. Then, the arbor 52 and the lever 53 rotate clockwise in FIG. 3, and the engaging piece 57*b* of the day-of-the-week correcting lever 57 is depressed. The pawl 57*a* therefore moves upwards, and engages with the pin 39 to feed it. Then, the day-of-the-week indicating plate 4 is fed in the same way as described above.

What is claimed is:

1. In a rotary plate-type digital display device for displaying the time in hours and minutes in digital form: a rotary minute drum; a set of minute-indicating plates containing minute time indicia and disposed around the periphery of said minute drum and being pivotable thereon so that angular movement of said minute drum in the forward direction causes said minute-indicating plates to successively pivot and turn over to thereby successively display the minute increment of time; a rotary hour drum disposed alongside said minute drum; a set of hour-indicating plates containing hour time indicia and disposed around the periphery of said hour drum and being pivotable thereon so that angular movement of said hour drum in the forward direction causes said hour-indicating plates to successively pivot and turn over to thereby successively display the hour increment of time; and drive means for continuously rotating said minute drum in the forward direction to effect successive turning over of said minute-indicating plates at one minute intervals and for intermittently rotating said hour drum in the forward direction to effect successive turning over of said hour-indicating plates at one hour intervals, said drive means comprising a rotatable drum shaft having said minute drum rotatably mounted thereon and having said hour drum fixedly mounted thereon, means for rotationally and continuously driving said minute drum about said drum shaft to individually turn over said minute-indicating plates at successive one minute intervals, and means responsive to the turning over of the 59th minute-indicating plate to effect angular movement of said drum shaft to accordingly advance said hour drum one increment in the forward direction to thereby turn over the next hour-indicating plate synchronously with the turning over of said 59th minute-indicating plate.

2. A rotary plate-type digital display device according to claim 1; wherein said drive means includes means for transmitting the angular movement of said minute drum to said hour drum only in response to pivotal movement and turning over of the 59th minute-indicating plate to thereby effect synchronous turning over of said 59th minute-indicating plate with each successive hour-indicating plate.

3. A rotary plate-type digital display device according to claim 1; wherein said means responsive to the turning over of the 59th minute-indicating plate comprises a cam secured to said minute drum for rotation therewith and having a cam profile which includes a crest, trough and a gradual transition between said crest and trough, a pivotable driving lever having one end engageable with only said 59th minute-indicating plate and having another end in camming contact with said cam profile such that during turning over of said 59th minute-indicating plate said another end of said lever slides from said crest to said trough thereby enabling pivotal movement of said driving lever in one direction to disengage itself from said 59th minute-indicating plate thereby setting it free to turn over, biasing means for biasing said driving lever in said one direction, a ratchet wheel secured to said drum shaft, and a pawl turnably mounted on said driving lever and engageable with said ratchet wheel to angularly drive the same to effect angular advancement of said drum shaft accomplished by corresponding angular advancement of said hour drum one increment in the forward direction in response to pivotal movement of said driving lever in said one direction.

4. A rotary plate-type digital display device according to claim 1; further including adjusting means for enabling manual angular adjustment of said minute and hour drums.

* * * * *